US005375443A

United States Patent [19]

Tamura

[11] Patent Number: 5,375,443

[45] Date of Patent: Dec. 27, 1994

[54] LOCK DEVICE

[75] Inventor: Shinichi Tamura, Nagoya, Japan

[73] Assignee: Tamura Plastic Mfg Co., Ltd., Komaki, Japan

[21] Appl. No.: 984,204

[22] Filed: Nov. 30, 1992

[30] Foreign Application Priority Data

Nov. 29, 1991 [JP] Japan ..... 3-342054

[51] Int. Cl.[5] ..... E05B 19/00

[52] U.S. Cl. ..... 70/352; 70/378; 70/387; 70/392

[58] Field of Search ..... 70/392, 393, 361, 387, 70/376, 377, 378, 350, 351, 352, 389, 390, 421

[56] References Cited

U.S. PATENT DOCUMENTS

| | | | |
|---|---|---|---|
| 2,388,227 | 10/1945 | Heyer | 70/350 |
| 2,505,494 | 4/1950 | Heyer . | |
| 2,692,495 | 10/1954 | Verdan . | |
| 3,681,953 | 8/1972 | Luttrall | 70/141 |
| 4,149,394 | 4/1979 | Sornes | 70/352 |
| 4,287,737 | 9/1981 | Ahn | 70/467 |
| 4,338,805 | 7/1982 | Nygren | 70/134 |
| 4,754,630 | 7/1988 | Kawakami | 70/352 |
| 4,838,058 | 6/1989 | Matsumoto | 70/355 |
| 5,025,647 | 6/1991 | Muus | 70/352 |
| 5,181,407 | 1/1993 | Wu | 70/387 |

FOREIGN PATENT DOCUMENTS

| | | | |
|---|---|---|---|
| 2037759 | 9/1991 | Canada | 70/352 |
| 62228578 | 2/1986 | Japan . | |
| 61-109027 | 11/1987 | Japan | 70/352 |
| 2081368A | of 0000 | United Kingdom . | |

*Primary Examiner*—Peter M. Cuomo
*Assistant Examiner*—Darnell Boucher
*Attorney, Agent, or Firm*—Lahive & Cockfield

[57] ABSTRACT

The present invention provides an improved lock device in which a slider is movable in either a locking direction or a releasing direction only when the amounts of projections of plural tumblers mounted on the slider correspond to the dimensions of plural holes punched in a lock card. When the lock card is slidingly inserted into a card groove under the release condition, the lock card successively presses a stopper disposed on the insertion side and the plural tumblers into tumbler chambers in the slider and then hits against a stopper disposed on the exit side, which projects into an adjustment groove. Here tapered tips of the tumblers are fitted into and engaged with the corresponding holes formed in the lock card, and engagement projections on the tumblers are all located in a sliding groove. The slider is thus movable together with the lock card. When the slider reaches a locked position and stops, the stopper on the exit side slides along an inclined edge of the adjustment groove and is received in the slider to allow the lock card to pass through for completion of the lock, and the stopper on the insertion side projects into the adjustment groove to prevent the lock card from sliding again in the locking direction.

18 Claims, 11 Drawing Sheets

LOCK DEVICE

BACKGROUND OF THE INVENTION

1. Field of the Invention

The present invention relates to a lock device which is locked and released through insertion of a lock card with plural holes punched therein;

2. Description of the Related Art

An example of such lock devices is disclosed in Japanese Patent Laying-Open Gazette No. 62-228578, which includes a slider having plural tumblers; a lock card with plural holes punched therein to determine the amounts of projections of the tumblers; a guide groove for guiding the lock card to the tips of the tumblers; and a mechanism for moving the slider only when the amount of projection of each tumbler becomes equal to a predetermined amount for completion of locking or releasing operation.

Another example disclosed in Japanese Patent Laying-Open Gazette No. 62-268481 further includes a step member formed in the slider to stop the lock card and move the slider upon the sliding pressure of the lock card.

In these prior art lock devices, the lock card moves the slider in a predetermined direction against the great resistance. Especially, in the latter structure, the step member formed in the slider temporarily stops the sliding of the lock card and prevents the smooth movement of the slider. These structures also require a number of parts for a sliding mechanism including tumblers and a slider, and a locking mechanism including engagement members and springs and are thereby not economically manufactured. In the above mechanism that the amounts of projections of the tumblers are determined by the holes punched in the lock card, forcible or too-quick sliding of a wrong lock card without the corresponding pattern of holes may cause mis-operation, that is, undesirable or accidental locking or releasing.

SUMMARY OF THE INVENTION

One object of the invention is to provide an improved lock device which ensures smooth and accurate locking and releasing operation.

Another object of the invention is to provide a lock device which effectively prevents mis-operation with a wrong lock card.

A further object of the invention is to provide a lock device which has a simple structure and is economically manufactured.

The above and other related objects are realized by a lock device of the invention, which includes:

(a) a lock plate having a longitudinal slot and plural side grooves extending perpendicular to and communicating with the longitudinal slot;

(b) a slider disposed over the longitudinal slot to be movable along the longitudinal slot between a locked position and an unlocked position, the slider having a locking pawl which is engaged and disengaged upon sliding motion of the slider;

(c) a row of plural tumblers mounted on the slider at positions corresponding to the side grooves, the plural tumblers being receivable within the slider and movable perpendicular to the longitudinal slot and parallel to the side grooves, each of the plural tumblers having: a projection on a main body thereof located in the longitudinal slot or a respective one of the side grooves upon the movement of the tumbler; and a tapered tip being projectable out of the slider;

(d) a guide element for guiding a lock card through a path formed parallel to the slider, the path receiving the tapered tips of the plural tumblers projected from the slider; and (e) a lock card for being inserted into and sliding through the path, the lock card having plural indentations therein at intervals to receive the tapered tips of respective ones of the plural tumblers, each of the indentations having dimensions to receive the tapered tip of respective one of the plural tumblers to a predetermined depth which allows the projection on the tumbler to be located in the longitudinal slot, at least one of the indentations having dimensions to receive the whole tapered tip of the corresponding one of the plural tumblers in such a manner that an end wall of the tumbler is fitted in inside walls of the indentation whereby the tumbler receives pressure sufficient to move the slider upon the sliding movement of the lock card;

wherein the slider being movable in either a locking direction or a releasing direction opposite to the locking direction only when amounts of projections of the tapered tips of the tumblers correspond to the respective indentations of the lock card.

The lock device of the invention further includes plural stoppers disposed on both sides of the row of plural tumblers on the slider, the plural stoppers being operated in connection with the sliding motion of the slider, one of the plural stoppers disposed on the exit side of the lock card projecting to prevent the lock card from sliding along the path when the slider is in the locked position, and the one stopper retracting to allow the lock card to slide along the path when the slider is in the unlocked position and moves along the longitudinal slot, the other of the plural stoppers disposed on the insertion side of the lock card projecting to prevent the lock card from sliding along the path after the whole length of the lock card passing through the other stopper.

Each of the plural stoppers receivable in the slider includes a tumbler body with a cavity formed therein extending along the longitudinal axis of the tumbler body; a tapered tip formed on one end of the tumbler body; and a coil spring being compressively received in the cavity of the tumbler body.

The guide element further includes an adjustment groove disposed in parallel with the path. The adjustment groove has inclined edges where the tapered tips of the stoppers slide upon the sliding movement of the lock card.

In the lock device of the invention, the slider is movable in either a locking direction or a releasing direction only when the amounts of projections of the plural tumblers mounted on the slider correspond to the dimensions of the plural indentations of the lock card.

When the lock card is inserted to slide through the path, the stopper disposed on the insertion side and the plural tumblers successively retract into the slider to allow the lock card to pass through. The lock card then hits against the stopper disposed on the exit side, which projects into the adjustment groove. Here the tapered tips of the tumblers are fitted into and engaged with the corresponding indentations of the lock card, and the projections on the tumblers are all located in the longitudinal slot. The slider is thus movable together with the lock card in either the locking or releasing direction.

When the slider reaches the locked position and stops, the stopper on the exit side slides along an inclined edge of the adjustment groove and is received in the slider to allow the lock card to pass through for completion of the lock or release, and the stopper on the insertion side projects into the adjustment groove to prevent the lock card from sliding again in the same locking or releasing direction.

As described above, the lock card first hits against the stopper disposed on the exit side of the lock card, where the lock card makes the amounts of projections of the tumblers correspond to respective predetermined values and allows the slider to move together with the lock card. Since the stoppers are receivable in the slider, the lock card can smoothly and securely move the slider.

When a wrong lock card without indentations or with a different pattern of indentations is inserted into the path, the stopper on the exit side effectively prevents the wrong lock card from passing through.

These and other objects, features, aspects, and advantages of the present invention will become more apparent from the following detailed description of the preferred embodiment with the accompanying drawings.

DESCRIPTION OF THE PREFERRED EMBODIMENT

A preferred embodiment off, the invention is described hereinafter with reference to the drawings.

Figure 1:
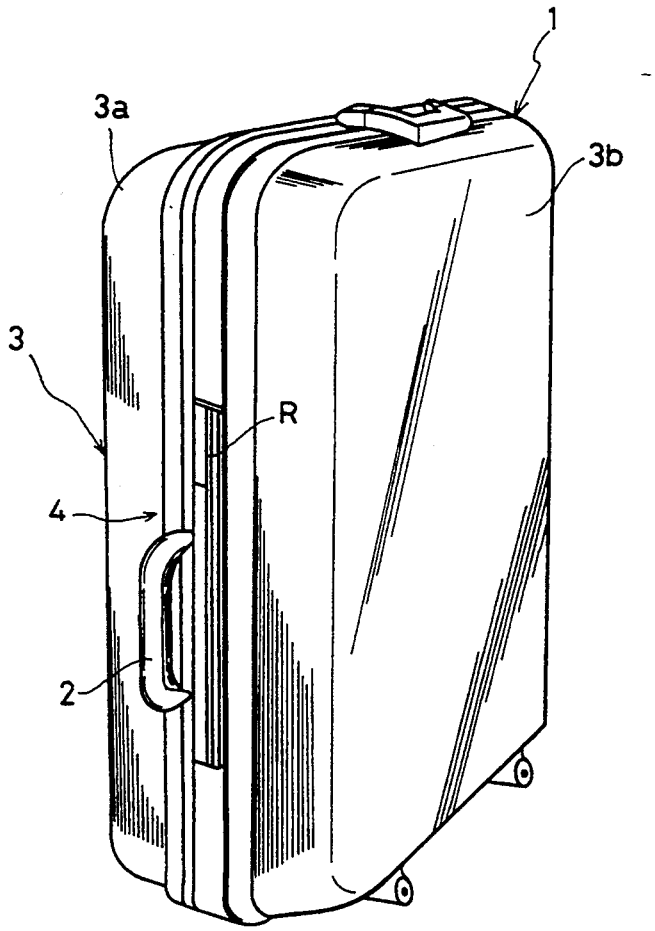
FIG. 1 is a perspective view illustrating a suitcase with a lock device embodying the invention.

FIG. 1 is a perspective view illustrating a suitcase 1 with a lock device embodying the invention. The suitcase 1 includes: a handle 2; and a case member 3 consisting of a first shell 3*a* and a second Shell 3*b*. A lock device 4 is mounted at a position R where the first shell 3*a* engages with the second shell 3*b*.

Figure 2:
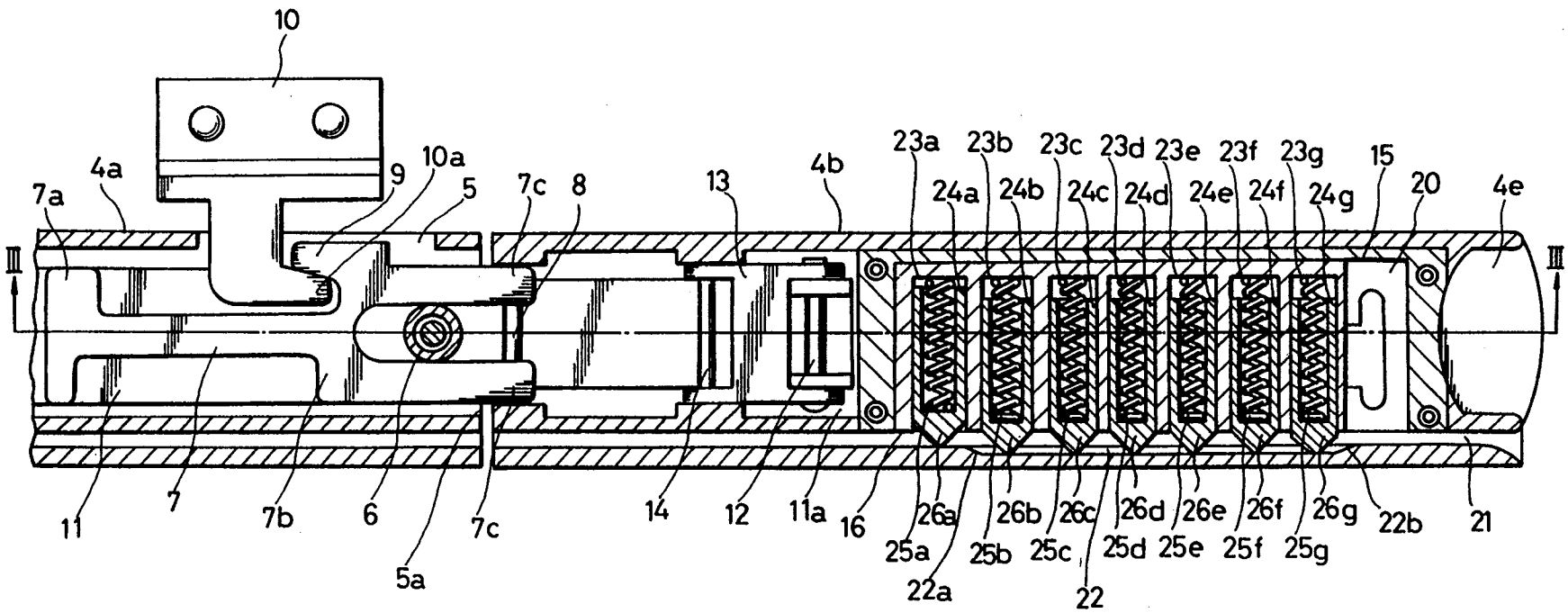
FIG. 2 is a cross sectional view showing the lock device of FIG. 1.
Figure 3:
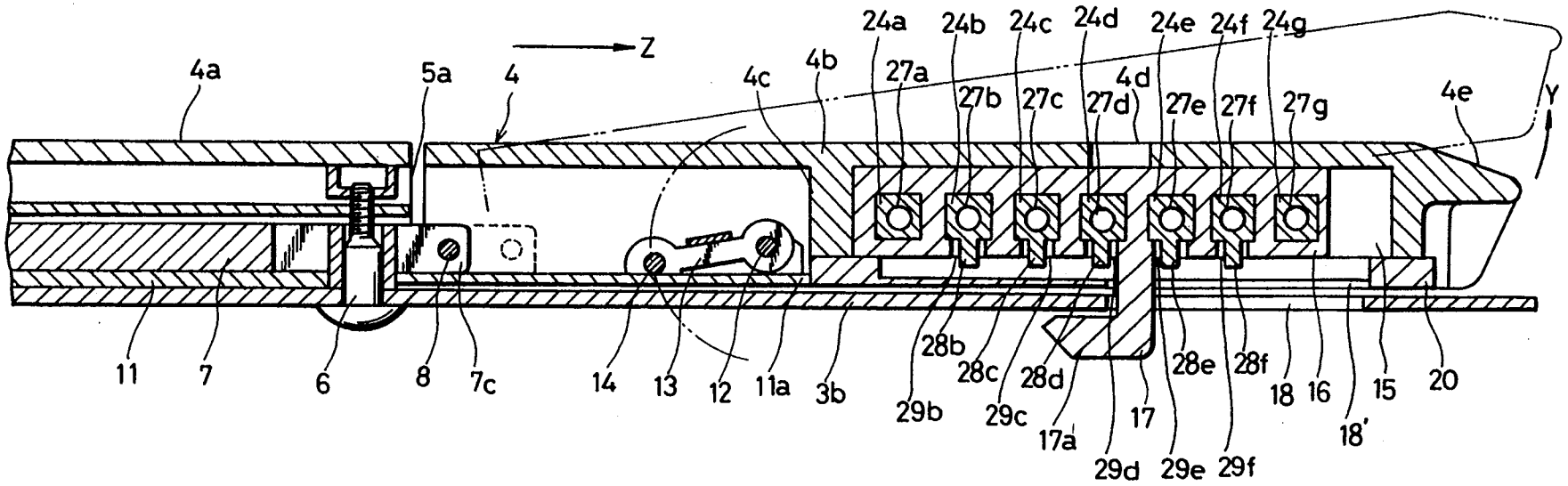
FIG. 3 is a cross sectional view taken on the line III—III of FIG. 2.

As shown in FIGS. 2 and 3, the lock device 4 includes a fixed assembly 4*a* and a lever assembly 4*b*. The fixed assembly 4*a* has openings 5 and 5*a* adjacent to the first shell 3*a* and the lever assembly 4*b*, respectively. The fixed assembly 4*a* is securely fixed to the second shell 3*b* with plural machine screws 6. The fixed assembly 4*a* has a stop member 7 composed of a light alloy cast. The stop member 7 has a T-shaped end 7*a* and a U-shaped end 7*b*, which passes through the opening 5*a* to project from the fixed assembly 4*a*. Projections 7*c*,7*c* of the stop member 7 are pivotally attached to a shaft member 8 having both ends fixed to the lever assembly 4*b*. The stop member 7 also has a hooked portion 9 formed in the middle thereof. The stop member 7 is not substantially movable in the transverse and vertical directions due to restriction of the fixed assembly 4*a*, but is freely slidable with the lever assembly 4*b* in the longitudinal direction.

An engaging member 10 fixed to the first shell 3*a* with two machine screws has a hooked end 10*a*. When the first shell 3*a* and the second shell 3*b* are joined together, the hooked end 10*a* of the engaging member 10 is inserted through the opening 5 into the fixed assembly 4*a* to engage with the hooked portion 9 of the stop member 7. Engagement of the hooked end 10*a* of the engaging member 10 with the hooked portion 9 of the stop member 7 fixes the first shell 3*a* to the second shell 3*b*.

An iron framework member 11 is fixed between the stop member 7 and the second shell 3*b* with the plural machine screws 6. The framework member 11 has one end 11*a* extending substantially to the middle of the lever assembly 4*b*. The end 11*a* of the framework member 11 supportably fixes a first shaft member 12 at a predetermined position in the lever assembly 4*b*. A link member 13 has one end rotatably attached to the first shaft member 12 and the other end supporting a second shaft member 14. The second shaft member 14 is accordingly pivotally movable around the first shaft member 12 as shown by the two-doted chain line of FIG. 3. Both the ends of the first shaft member 12 and the second shaft member 14 are rotatably supported by the lever assembly 4*b*, and thereby the lever assembly 4*b* is also pivotally movable around the first shaft member 12. The upper part of the lever assembly 4*b* is provided with a window 4*d* through which the lock or release condition is checked.

In the lever assembly 4*b*, a sliding unit 15 is disposed on the right side of a partition plate 4*c* in FIGS. 2 and 3. The sliding unit 15 includes: a slider 16 being slidable along a longitudinal axis of the lever assembly 4*b*; and an L-shaped locking pawl 17 being arranged below the slider 16 of the lever assembly 4*b*. One end 17*a* of the locking pawl 17 extends in the direction of the fixed assembly 4*a*. The sliding movement of the slider 16 engages and releases the locking pawl 17 with and from the second shell 3*b* via a locking slot 18 formed in the second shell 3*b*.

Figure 4:
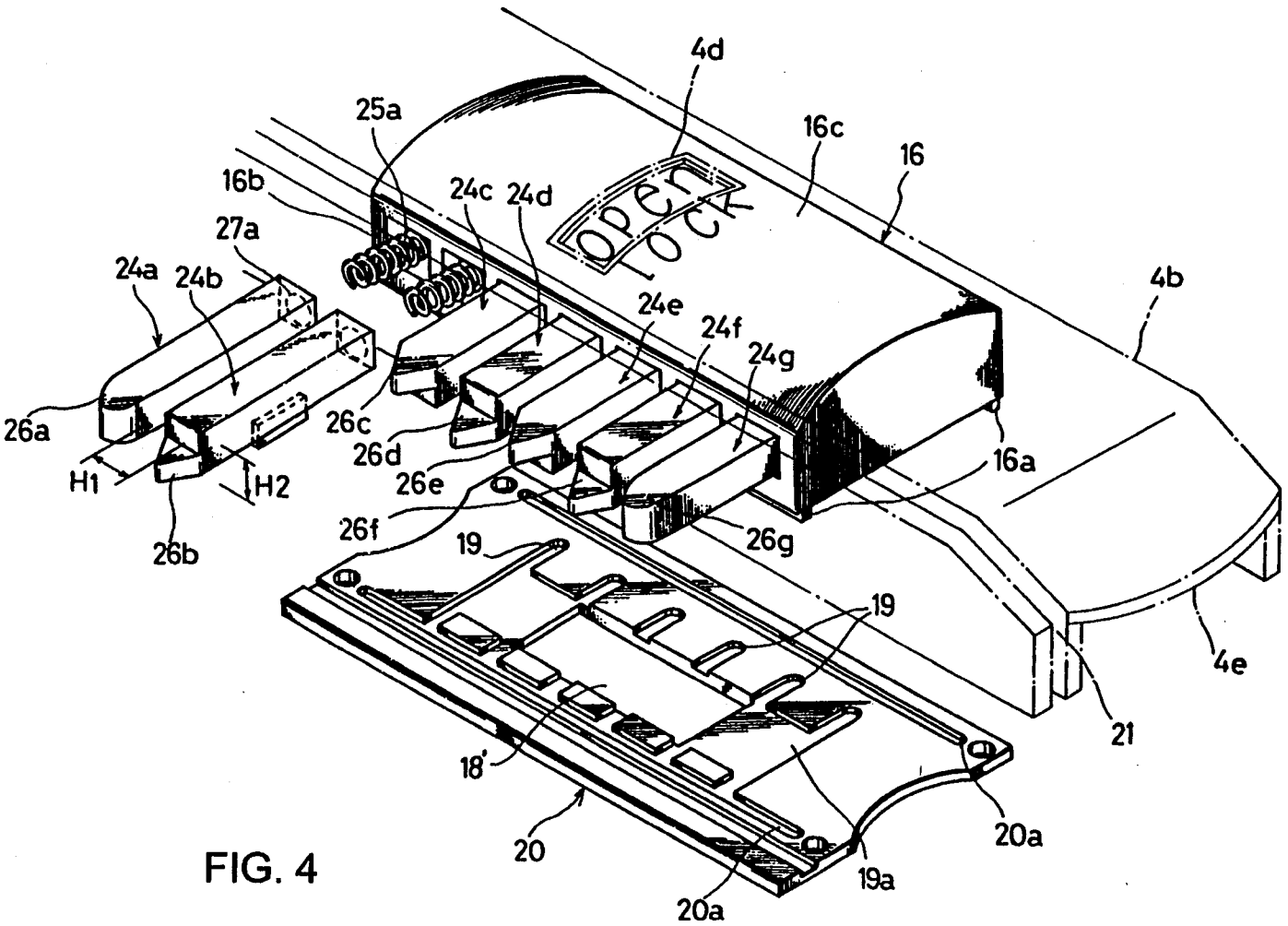
FIG. 4 is a partly decomposed perspective view showing structure of a lever assembly of the lock device.

As shown in FIG. 4, a lock plate 20 is bolted to the lever assembly 4*b* between the slider 16 and the second shell 3*b*. The lock plate 20 has: plural guide grooves 20*a*, 20*a* which receive plural rails 16*a*, 16*a* projected downward from the slider 16; and a slit 18' formed on the center thereof. The slit 18' of the lock plate 20 has a length sufficient for sliding movement of the locking pawl 17 inserted through the slit 18'. The lock plate 20 further includes six engagement grooves 19,19 for receiving engagement projections of tumblers described later. The elliptic engagement grooves 19,19 each extending perpendicular to the slit 18' are arranged at fixed intervals along the longitudinal axis. The engagement grooves 19,19 are connected to one another via a sliding groove 19*a* which has the same width as the slit 18'.

As shown in FIG. 2, a card groove 21 extending along the whole length of the lever assembly 4b is formed below the lever assembly 4b. A lock card P is slidable along a side face 16b of the slider 16 in the card groove 21. An adjustment groove 22 having inclined edges 22a and 22b is further formed outside the card groove 21 to determine the maximum projections of tumblers 24b through 24f described later. The slider 16 includes a row of tumbler chambers 23a, 23b, 23c, 23d, 23e, 23f, and 23g arranged at fixed intervals in the longitudinal direction as clearly seen in FIG. 2. Each tumbler chamber has an opening on the side of the card groove 21 in the transverse direction of the slider 16. As shown in FIGS. 2 through 4, the tumbler chambers 23a and 23g disposed at the ends of the row respectively receive stoppers 24a and 24g which are quadratic prisms in shape and have tapered tips 26a and 26g. Coil springs 25a and 25g, which are inserted into cavities 27a and 27g formed on the rear face of the stoppers 24a and 24g, press the stoppers 24a and 24g against the adjustment groove 22 (see FIG. 6).

Figure 5:
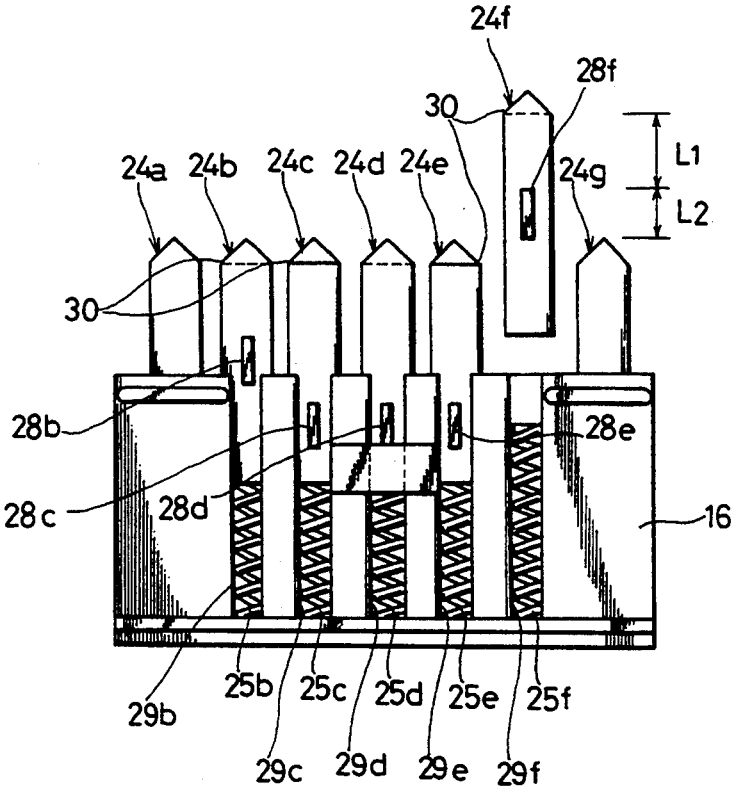
FIG. 5 is a schematic view illustrating tumblers and stoppers mounted on a sliders.

The other tumbler chambers 23b through 23f receive tumblers 24b through 24f having cavities 27b through 27f and being pressed by means of coil springs 25b through 25f in the same manner as the stoppers 24a and 24g. The tumblers 24b through 24f respectively have rectangular engagement projections 28b through 28f extending in the direction of the lock plate 20. The engagement projections 28b through 28f are respectively located at predetermined positions of the tumblers 24b through 24f as shown in FIG. 5. The engagement projections 28b through 28f respectively project into the engagement grooves 19,19 via slits 29b through 29f formed in the tumbler chambers 23b through 23f of the slider 16 on the side of the second shell 3b. When all the engagement projections 28b through 28f are located in the sliding groove 19a connecting the plural grooves 19,19 to one another, the slider 16 slidably moves along the longitudinal axis in the sliding unit 15. When any of the engagement projections 28b through 28f is located in the corresponding engagement groove 19, the slider 16 is not movable along the longitudinal axis. Two words 'LOCK' and 'OPEN' representing the lock and release conditions are printed on an upper face 16c of the slider 16 so as to be readable through the window 4d of the lever assembly 4b.

The main bodies of the tumblers 24b through 24f are quadratic prisms in shape as in the case of the stoppers 24a and 24g. The alternate tumblers 24b, 24d, and 24f have tapered tips 26b, 26d and 26f formed on the lower half of their ends while the other tumblers 24c and 24e have tapered tips 26c and 26e formed on the upper half of their ends as seen in FIG. 4. The position of the engagement projection 28b, 28c, 28d, 28e, or 28f on each tumbler is determined by selecting a combination of lengths L1 and L2 (shown in FIG. 5) from three combinations listed in Table 1.

TABLE XX1

| NO. | L1 | L2 |
|---|---|---|
| 1 | $A + \alpha$ | B |
| 2 | A | B |
| 3 | $A - \alpha$ | B |

When the length L1 is equal to A, that is, when the combination No. 2 is selected in Table 1, the engagement projection is located on the center of the longitudinal axis of the tumbler. Accordingly, the engagement projection is located on the lower portion of the tumbler in the combination No. 1 and on the upper portion of the tumbler in the combination No. 3. Here it is preferable that $\alpha$ is less than the total width off, the card groove 21 and the adjustment groove 22 and that B is less than the difference between the width of the sliding groove 19a and the total width of the card groove 21 and the adjustment groove 22.

In the embodiment, the combination No. 1 is applied to the alternate engagement projections 28c and 28e, whereas the combination No. 2 being applied to the other engagement projections 28b, 28d, and 28f.

Figure 7:
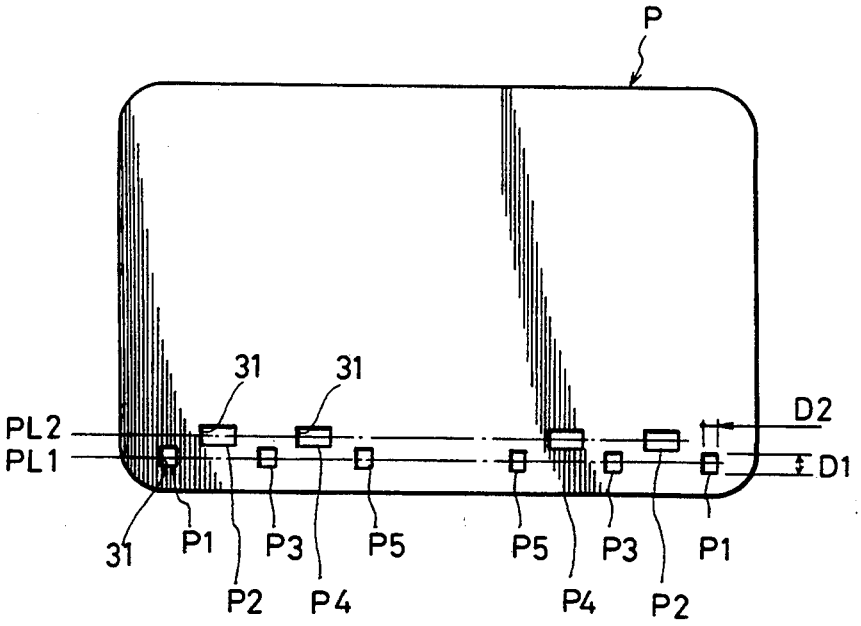
FIG. 7 is a front view illustrating a lock card.

The amounts of projections of the tumblers 24b through 24f are determined corresponding to the engagement projections 28b through 28f on the tumblers by the lock card P shown in FIG. 7. The position of the engagement projection on each tumbler is determined by the relationship between the tapered tip of the tumbler and the corresponding one of plural holes P1 through P5 punched in the lock card P. As seen in FIG. 7, the alternate holes P1, P3, and P5 are aligned on a first line PL1, while the other holes P2 and P4 being aligned on a second line PL2. These five holes P1 through P5 are arranged at the intervals corresponding to those of the tumblers 24b through 24f. Two sets of the holes P1 through P5 are formed in bilaterally symmetrical arrangement along the longitudinal axis of the lock card P. The first line PL1 of the lock card P is moved along the center of the tapered tips 26b, 26d, and 26f formed on the tumblers 24b, 24d, and 24f. The second line PL2 is moved along the center of the tapered tips 26c and 26e formed on the tumblers 24c and 24e. Dimensions D1 and D2 (shown in FIG. 7) are selected from three combinations listed in Table 2.

TABLE XX2

| NO. | D1 | D2 |
|---|---|---|
| 1 | D | E |
| 2 | D | $E - \beta$ |
| 3 | 0 | 0 |

The combinations No. 1 through No. 3 of Table 1 correspond to the combinations No. 1 through No. 3 of Table 2, respectively. When the same combination number, for example, No. 1, is selected for both the tumbler and the corresponding hole of the lock card P, the amount of projection of the tumbler reaches a predetermined value. In Table 2, D represents the dimension for fittingly receive a width H1 of the tapered tip of the tumbler, and E denotes the dimension for fittingly receive a height H2 of the tapered tip.

At least one of the holes P1 through P5 is a full hole having dimensions to receive the whole tapered tip of the tumbler. In the embodiment, P2 and P4 are full holes of the combination No. 1 and P1, P3, and P5 are smaller holes of the combination No. 2 in Table 2.

When the combination No. 1 is selected in Table 2 like the holes P2 and P4, a boundary wall 30 of the tumbler 24c or 24e is brought into contact with inner walls 31 of the full hole P2 or P4 formed in the lock card P. The boundary wall 30 defining the border between the main body of each tumbler and the tapered tip is formed substantially perpendicular to the sliding surface of the lock card P. The tumblers 24c and 24e inserted into the full holes P2 and P4 of the lock card P thus have large pressure in the sliding direction of the lock card P.

When the combination No. 2 is selected in Table 2 like the holes P1, P3, and P5, the tapered tip **26*b*, 26*d*, or 26*f* is into contact with inside walls 31 of the hole P1, P3, or P5**. When the combination No. 3 is selected in Table 3, no hole is punched in the lock card P and the tapered tip of the tumbler is not inserted through the lock card P. In the case of either the combination No. 2 or No. 3, sliding movement of the lock card P does not apply large pressure onto the tumbler in the sliding direction.

Figure 8:
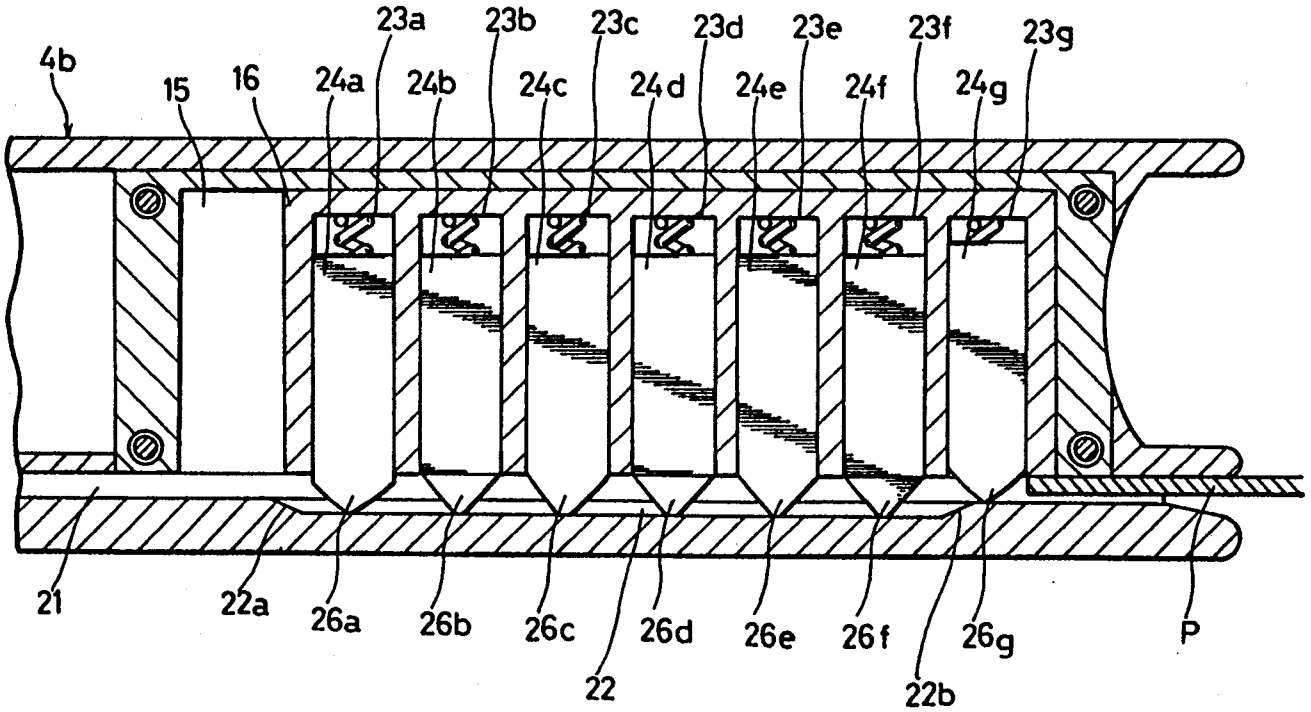
FIG. 8 is a schematic view illustrating the lock card sliding in a card groove under the release condition.

When the lock device thus constructed is under the release or unlock condition, the slider 16 is located at the rightmost position in the sliding unit 15, that is, adjacent to an end portion **4*e* of the lever assembly 4*b* as shown in FIG. 8. The tumblers 24*b* through 24*f* and the stoppers 24*a* and 24*g* are located at the positions of FIG. 8. The stopper 24*a* on the left end projects into the adjustment groove 22 to prevent the lock card P from being mistakenly inserted from the side of the fixed assembly 4*a* and sliding rightward. The tapered tip 26*g* of the stopper 24*g* slides along the inclined edge 22*b* of the adjustment groove 22 to be located in the card groove 21 and received in the tumbler chamber 23*g*. When the lock card P is inserted from the side of the end portion 4*e* of the lever assembly 4*b* and slides along the card groove 21 leftward to the fixed assembly 4*a*, the stopper 24*g* and the tumblers 24*f* through 24*b* are successively pressed into the tumbler chambers 23*g* through 23*b*. During the sliding movement of the lock card P in the locking direction, one or plural of the engagement projections 28*b* through 28*f* are located in the corresponding engagement grooves 19,19, thus preventing the movement of the slider 16**.

Figure 6:
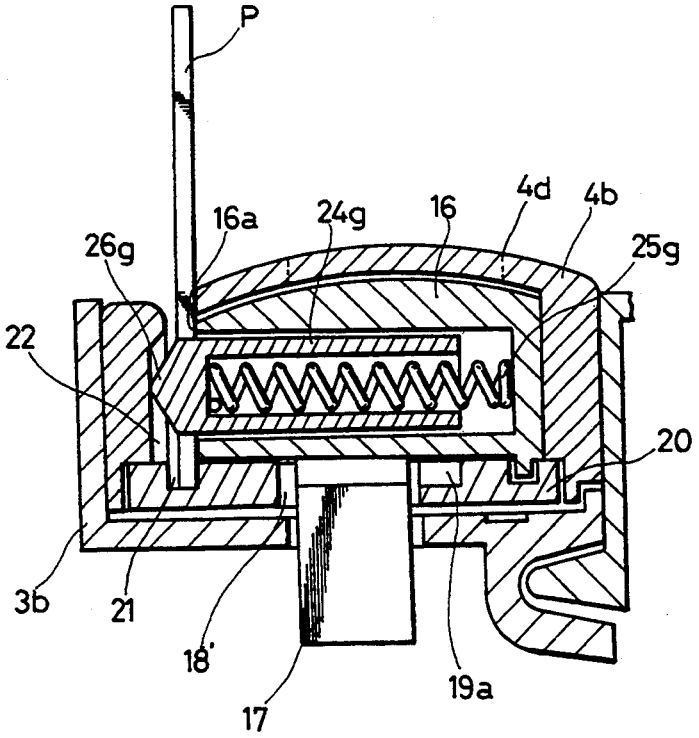
FIG. 6 is a cross sectional view showing the lever assembly of the lock device.
Figure 9:
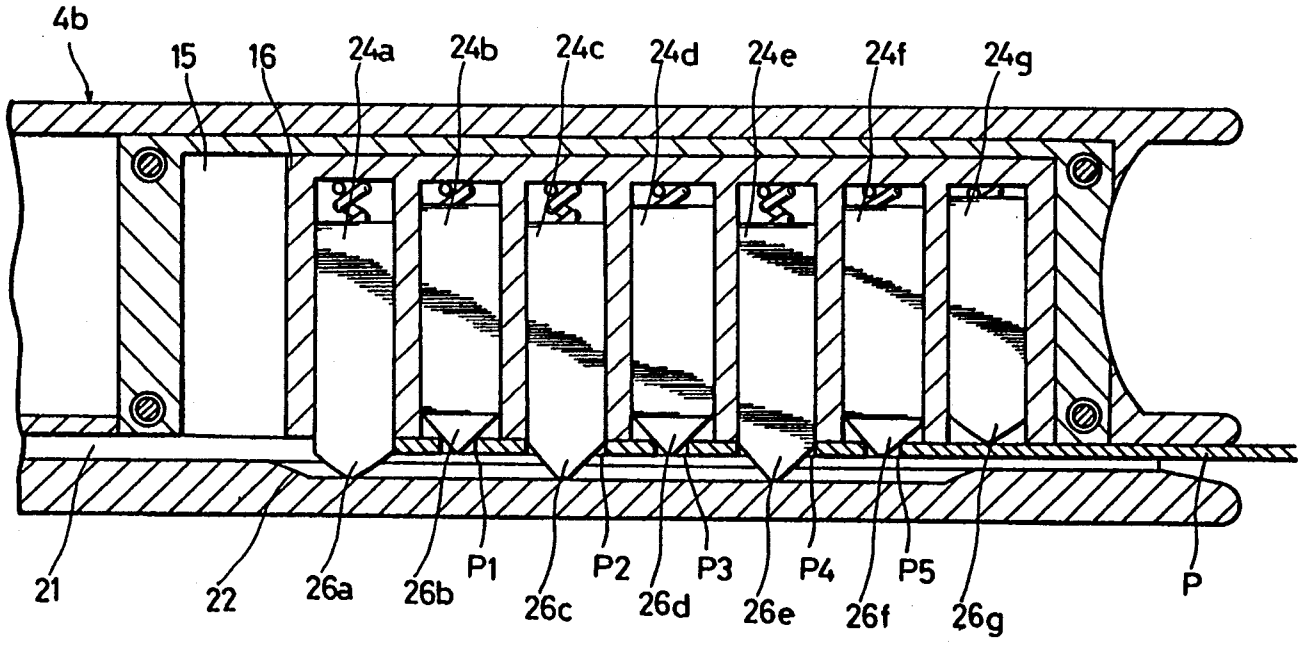
FIG. 9 is a schematic view illustrating the lock card sliding in the card groove in the locking direction.
Figure 10:
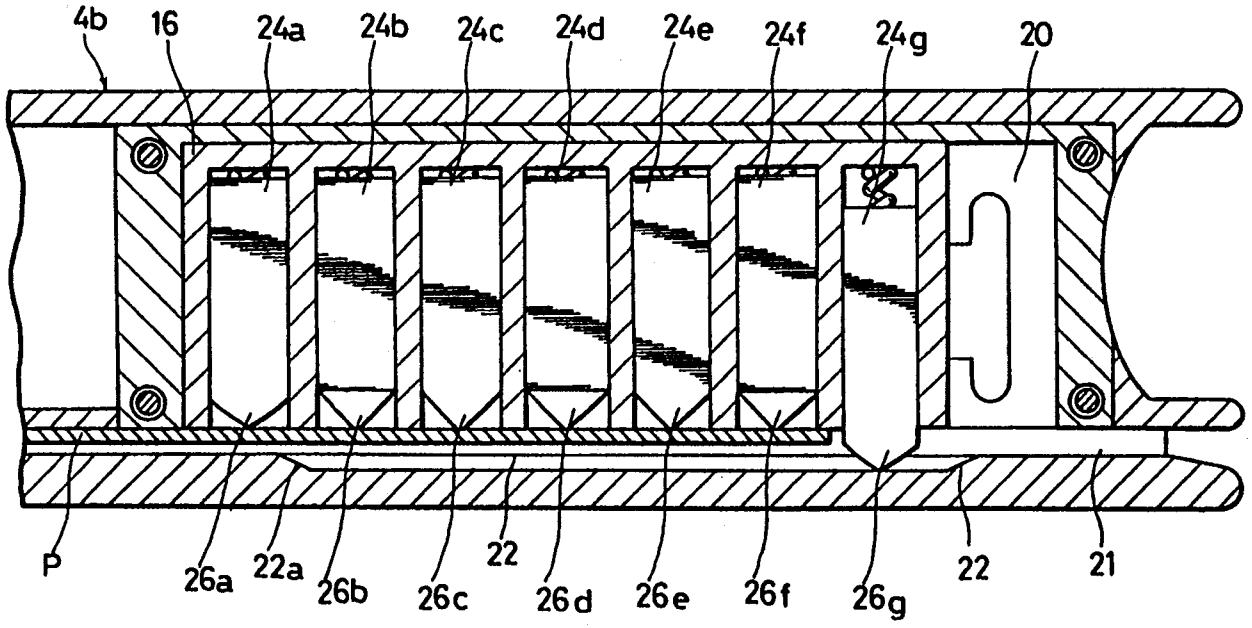
FIG. 10 is a schematic views illustrating the lock card sliding in the card groove to complete the lock.
Figure 11:
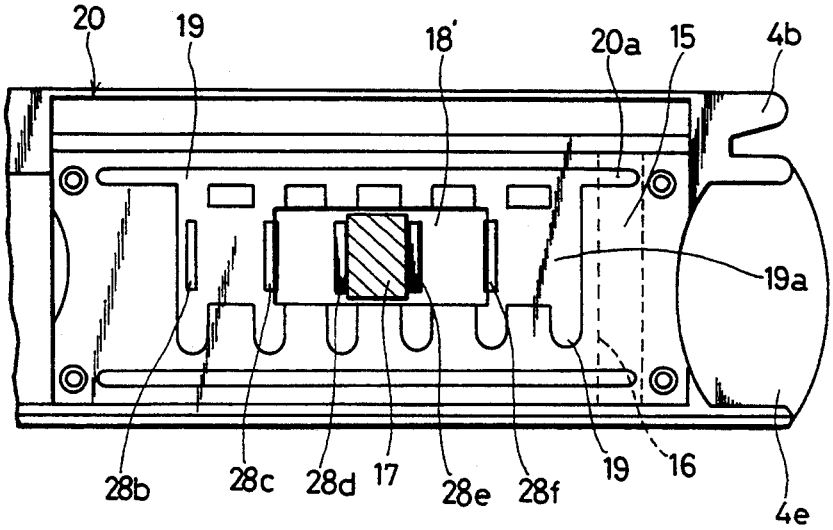
FIG. 11 is a schematic view illustrating a condition under which the lock card makes the amounts of projections of the tumblers correspond to respective predetermined values.

When a first end of the lock card P reaches the stopper **24*a*, all the tapered tips 26*b* through 26*f* of the tumblers 24*b* through 24*f* engage with the corresponding holes P1 through P5 in the lock card P as shown in FIG. 9 and all the engagement projections 28*b* through 28*f* of the tumblers are located in the sliding groove 19*a* as shown in FIG. 11, thus allowing the slider 16 to move in the longitudinal direction. The tumblers 24*c* and 24*e* inserted through the full holes P2 and P4 of the lock card P receive large pressure in the sliding direction of the lock card P, and the slider 16 thus slides leftward with the sliding motion of the lock card P while being in contact with the stopper 24*a*. When the slider 16 is moved to the leftmost position in the sliding unit 15, that is, adjacent to the fixed assembly 4*a*, the taper tip 26*a* of the stopper 24*a* slides along the inclined edge 22*a* of the adjustment groove 22 to be located in the card groove 21 and received into the tumbler chamber 23*a*. The lock card P further slides leftward through the card groove 21, while successively pressing the tumblers 24*b* through 24*f* into the tumbler chambers 23*b* through 23*f* to complete the lock as shown in FIG. 10. After a second end of the lock card P passing through, the stopper 24*g* on the right end projects into the adjustment groove 22, as shown in FIG. 6, to prevent the lock card P from being inserted again from the side of the end portion 4*e*** and sliding leftward.

Since the locking pawl 17 disposed below the slider 16 moves together with the slider 16 in the sliding direction, the end **17*a* of the locking pawl 17 engages with the locking slot 18 formed in the second shell 3*b* so as to fix the lever assembly 4*b* to the second shell 3*b*. Under such a lock condition, the hooked portion 9 of the stop member 7 is not movable in the fixed assembly, and the first shell is locked to the second shell 3*b* as shown in FIG. 2**.

Release or unlock procedures are briefly described. When the lock card P is inserted from the side of the fixed assembly **4*a* and slides rightward along the card groove 21, the stoppers 24*a* and 24*g* and the tumblers 24*b* through 24*f* function in the reverse manner to the above. The lock card P moves the slider 16 in the direction of the end portion 4*e* of the lever assembly 4*b* while being in contact with the stopper 24*g*. The locking pawl 17 moves rightward with the slider 16 to release the engagement of the lever assembly 4*b* with the second shell 3*b*. When the end portion 4*e* of the lever assembly 4*b* is pulled upward as shown by the arrow Y in FIG. 3, the lever assembly 4*b* becomes pivotally movable about the first shaft member 12 and the second shaft member 14 as shown by the two-doted chain line. The lever assembly 4*b* is thus movable both in the directions of the arrow Y and the arrow Z. The movement of the lever assembly 4*b* slides the stop member 7 connected to the lever assembly 4*b* in the direction of the arrow Z. Engagement of the hooked end 10*a* of the engaging member 10 with the hooked portion 9 of the stop member 7 is thus released, and the first shell 3*a* is separated from the second shell 3*b*, that is, the suitcase 1** is opened.

In the above embodiment, under both the lock and release conditions, either the stopper **24*a* or 24*g* positioned on the exit side of the lock card P (24*g* under the lock condition and 24*a* under the release condition) projects into the adjustment groove 22. When the lock card P slides in the wrong direction or when a wrong lock card without holes or with holes not corresponding to the tapered tips 26*b* through 26*f* of the tumblers 24*b* through 24*f* is inserted, the stopper 24*a* or 24*g* projecting into the adjustment groove 22** prevents further sliding of the lock card. Even the correct lock card P is slidable in the locking direction under the release or unlock condition and in the releasing direction under the lock condition. In any case, the stopper on the exit side in the card groove halts the movement of the lock card, thus effectively preventing forcible sliding of the wrong lock card or mis-operation of the lock card due to too-quick sliding thereof. The stoppers thereby have a function of checking the holes of the lock card.

It is clearly understood that the above embodiment is only illustrative and not restrictive in any sense since the invention may be embodied in other forms without departing from the scope or spirit of essential characteristics thereof. Some examples of modification are given below.

The tumblers of the above embodiment are quadratic prisms in shape, but may be cylinders or any polyhedrons. Neither the number of the tumblers, the number and shape of the corresponding holes punched in the lock card, nor the shape of the engagement grooves and the sliding groove formed on the lock plate are limited to the above embodiment. The lock device may be mounted at any desirable position of the suitcase.

The spirit and scope of the present invention is limited only by the terms of the appended claims.

What is claimed is:

1. A lock device comprising a lock plate having a longitudinal slot and a plurality of side grooves extending perpendicular to and communicating with said longitudinal slot, b a slider disposed over said longitudinal slot to be movable along said longitudinal slot between a locked position and an unlocked position, said slider having a locking pawl which is engaged and disengaged with at least said lock plate upon sliding motion of said slider between said locked and unlocked positions, respectively, a row of tumblers having an insertion side and an exit side and being mounted in said slider at positions corresponding to said side grooves, said tumblers being receivable within said slider and movable perpendicular to said longitudinal slot and parallel to said side grooves, each of said plural tumblers having a projection formed on a main body thereof located in said longitudinal slot or a respective one of said side grooves upon the movement of said tumbler, and further having formed a tapered tip at one end and being projectable out of said slider, guide means for guiding a lock card through a path formed in said lock device and disposed substantially parallel to said slider, said path receiving said tapered tips of said plural tumblers projected from said slider, a lock card for insertion into and sliding through said path, said lock card having plural indentations formed therein at intervals to receive said tapered tips of respective ones of said plural tumblers, each of said indentations having dimensions to receive said tapered tip of a respective one of said tumblers to a predetermined depth for allowing said projection on said tumbler to be located in said longitudinal slot, at least one of said indentations having dimensions to receive the whole tapered tip of the corresponding one of said plural tumblers in such a manner that an end wall of said tumbler is fitted in inside walls of said indentation whereby said tumbler receives pressure sufficient to move said slider upon the sliding movement of said lock card, and wherein said slider is movable in either a locking direction or a releasing direction opposite to said locking direction only when selected amounts of projections of said tapered tips of said tumblers correspond to said respective indentations of said lock card, said lock device further includes at least two stoppers, one disposed on each side of said row of tumblers, one of said stoppers being disposed on the exit side of said row of tumblers and projecting from said slider to prevent said lock card from sliding along said path when said slider is in said locked position, the other of said plural stoppers being disposed on the insertion side of said row of tumblers and projecting from said slider selectively to prevent said lock card from sliding along said path after the entire length of said lock card passes through said other stopper.

2. A lock device in accordance with claim 1, wherein each of said stoppers comprises a tumbler body with a cavity formed therein extending along the longitudinal axis of said tumbler body, a tapered tip formed on one end of said tumbler body, and a coil spring compressively received in said cavity of said tumbler body.

3. A lock device in accordance with claim 2, wherein said stoppers are receivable within said slider.

4. A lock device in accordance with claim 1, wherein said plural indentations of said lock card comprise holes through said lock card.

5. A lock device in accordance with claim 1, wherein said guide means further comprises an adjustment groove substantially disposed parallel to said path.

6. A lock device in accordance with claim 5, wherein said adjustment groove has inclined edges where said tapered tips of said stoppers slide thereon upon the sliding movement of said lock card.

7. A lock device in accordance with claim 4, wherein said plural holes of said lock card are substantially rectangular in shape.

8. A lock device in accordance with claim 7, wherein said main body of said tumbler and the tumbler body of said stopper are substantially quadratic prisms in shape.

9. A lock device in accordance with claim 7, wherein some of said rectangular holes have a size different from that of the others of said rectangular holes.

10. A lock device in accordance with claim 9, wherein some of said tapered tips of said tumblers are disposed along a line offset from a line along which the others of said tapered tips are disposed.

11. A lock device in accordance with claim 1, wherein each of said tumblers has a cavity formed in the main body thereof, and a coil spring compressively received in said cavity of said tumbler.

12. A lock device actuatable with a removable lock card, said lock device comprising A. a lock plate having a first slot and plural side grooves transverse to and in communication with said first slot.

B. a slider having an upper face and a lower face and disposed over said first slot and movable thereon along said first slot between a locked position and an unlocked position, said slider further having a locking pawl disposed on said lower face and alternately disposed in an engaging position when said locking pawl engages with said lock plate via said first slot in said locked position and in a disengaging position when said locking pawl disengages with said lock slot in said unlocked position, C. guide means having an insertion side and an exit side for guiding a lock card along a path longitudinal with said first slot and formed parallel to said slider, D. a plurality of tumblers disposed in a row and mounted on said slider at positions corresponding to said side grooves, said tumblers being receivable within apertures formed within said slider and movable in a direction transverse to said first slot and parallel to said side grooves, said tumblers selectively projecting into said path, and E. at least two stoppers, one disposed on each side of said row of tumblers, wherein at least one of said stoppers projects into said guide means at said exit side for preventing said lock card from sliding within said path when said slider is placed in said locked position, while at least one corresponding stopper disposed on said opposite side of said row retracts within said aperture to allow passage of said card into said path, and at least one of said stoppers projects into said guide means at said insertion side for preventing said lock card from sliding along said path after the lock card slides across said stopper.

13. A lock device according to claim 12, wherein each said tumbler further comprises a main body having an upper face and a lower face and corresponding first and second ends, a tapered tip formed on one end of said main body, a projection formed on the lower face of said main body, said projection being receivable within said side grooves and said longitudinal slot, a cavity formed within said main body, a spring compressively received in said cavity of said tumbler.

14. A lock device according to claim 12, wherein each of said plural stoppers comprises a tumbler having a main body having a cavity formed therein, a tapered tip formed on one end of said tumbler body, and a coil spring compressively received in said cavity of said tumbler body.

15. A lock device according to claim 14 wherein said slider is arranged for receiving said stoppers.

16. A lock device according to claim 12 wherein said guide means further comprises an adjustment groove disposed in parallel with said path.

17. A lock device according to claim 16, wherein said adjustment groove has inclined edges, and said tapered tips of said stoppers slide on said edges upon the sliding movement of the lock card.

18. A lock device according to claim 12, wherein said tumbler main body and said stopper main body are quadratic prisms in shape.

* * * * *